United States Patent [19]

Zysset

[11] Patent Number: 5,069,356

[45] Date of Patent: Dec. 3, 1991

[54] EASY OPEN END WITH TEMPORARY RETENTION CENTER FOR SAFETY PURPOSES

[75] Inventor: Edgar H. Zysset, St. Cloud, Fla.

[73] Assignee: Automated Container Corporation, Plymouth, Fla.

[21] Appl. No.: 611,692

[22] Filed: Nov. 8, 1990

[51] Int. Cl.[5] ..... B65D 17/40; B65D 51/44

[52] U.S. Cl. ..... 220/276; 220/270; 413/14; 413/16

[58] Field of Search ..... 220/266, 268, 269, 270, 220/276, 271, 272, 273; 413/12, 14, 15, 16

[56] References Cited

U.S. PATENT DOCUMENTS

| | | | |
|---|---|---|---|
| 2,946,478 | 7/1960 | Clair, Jr. et al. | 220/270 |
| 3,552,342 | 1/1971 | Brown | 413/16 X |
| 3,877,605 | 4/1975 | Fourier | 220/271 |
| 4,350,261 | 9/1982 | Roth | 220/270 |
| 4,801,038 | 1/1989 | Grigorenko | 220/269 |

*Primary Examiner*—Stephen Marcus
*Assistant Examiner*—Nova Stucker
*Attorney, Agent, or Firm*—Duckworth, Allen, Dyer & Doppelt

[57] ABSTRACT

An end panel for an easy open end includes a pull tab fixed to the removable inside portion and a score line having two different defined depths, including a first severing depth passing under the nose of the pull tab and substantially all of the remaining areas except for an area rearward of the pull tab, where the score line extends to a second, shallower temporary retention depth in order to retain the rearward area with the outside portion as the inside portion moves outwardly away from the container during either inadvertent or intentional opening.

11 Claims, 1 Drawing Sheet

EASY OPEN END WITH TEMPORARY RETENTION CENTER FOR SAFETY PURPOSES

BACKGROUND OF THE INVENTION

The present invention relates to easy open ends for pressurized containers, and methods for manufacturing easy open ends.

An easy open end is generally described as one in which the entire end of the container may be removed without using a can opener or similar tool. Generally, easy open ends of this type employ an end panel with a curved score line in the panel defining a removable inside panel portion which is severable from a remaining outside portion of the panel. A pull tab is fixed along one side of the removable inside portion, and includes a nose which may be driven into the score line; the entire inside panel portion is then removed by simply pulling the tab outwardly, to complete the severing along the score line. The depth of the score line into the end panel is specifically selected to insure complete severing of the score line during the removal process.

Some applications of easy open containers for consumer products require pressurization; tennis ball containers are an example of such pressurized containers. From time to time, such pressurized containers are inadvertently dropped from a height or fall from a display shelf, often causing accidental opening; under these conditions, the internal pressure can rapidly rupture the end panel along the score line. Since the removable end panel has a jagged edge along the score line, then such accidental openings have caused consumer injuries.

SUMMARY OF THE INVENTION

The present invention is directed to an easy open end for pressurized containers, and the method for making such ends, which temporarily retains the removable inside panel portion for safety purposes during either inadvertent or intentional opening of the end. To achieve these purposes, an easy open end for pressurized containers in accordance with the present invention includes an end panel and a score line extending about at least a portion of the periphery of the end panel and defining a removable inside panel portion severable from a remaining outside portion of the panel. Means, such as a pull tab, is installed along a first side of the end panel for severing the score line, and means are provided along a second side of the end panel generally opposite the first side for temporarily retaining the second side with the outside portion as the first side moves outwardly away from the container during opening. Thereafter, the temporary retaining means is overcome so as to release the inside panel portion responsive to repeated movements of the first side of the inside portion toward and away from the container.

In the preferred embodiment of the present invention, as described below, the score line passes in an area under the nose of the pull ring and extends in an enclosed curved path about the end panel, the score line extending a first, severing depth into the end panel in the area under the pull tab nose and in substantially all of the remaining areas of the score line except in an area rearward of the pull tab. The score line in the rearward area extends to a second, temporary retention depth along that rearward area. It is also preferred that the score line define two small areas of the temporary retention depth each on opposite sides of the pull tab nose.

It will be appreciated by those skilled in the art that the temporary retention means may be a weakened area coextensive with, and even forming a part of, the severing score line.

DETAILED DESCRIPTION

A preferred embodiment of the preferred invention will now be described with reference to FIGS. 1-4.

Figure 1:
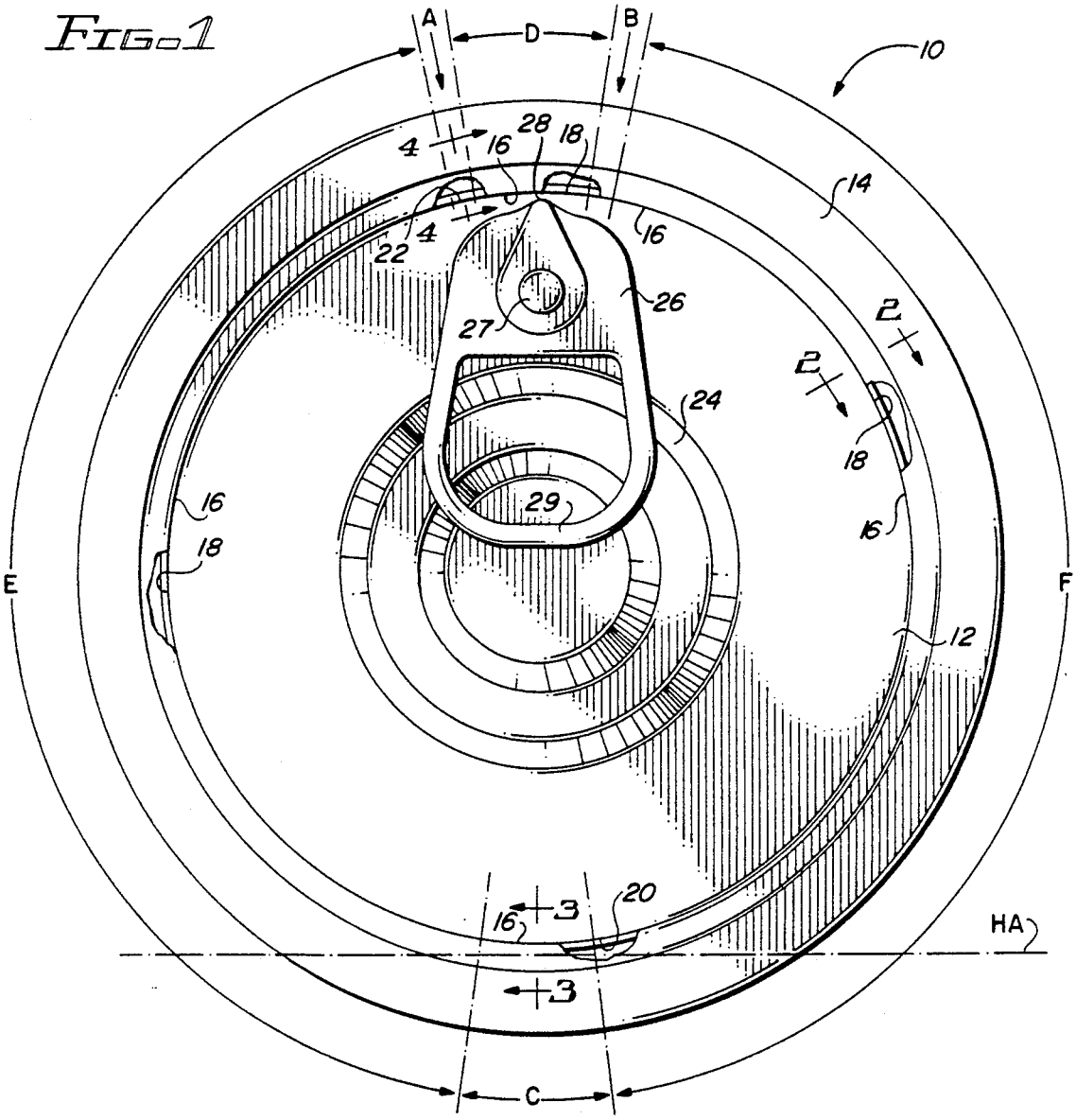
FIG. 1 is a top plan view of an end panel in accordance with the present invention, in which dotted lines are used to identify areas of the score line having a shallow, temporary retention depth.

In FIG. 1, the end panel is referred to generally by the reference numeral i0. The end panel 10 includes a removable inside panel portion 12, an outside panel portion 14 and a curved, protective bead !6. The inside and outside panel portions !2, 14 are separated by a score line, which is described in greater detail below.

Fixed to the inside panel 12 is a pull tab 26 joined by a rivet 27. The pull tab has a forward nose 28 and a pull ring 29. As is known, the pull tab may be operated by pulling upward on the pull ring 29, driving the nose 28 into the end panel for severing purposes. To facilitate movement of the pull ring 29, the inside panel 12 includes a depression 24 in its center underneath the pull ring.

Figure 2:
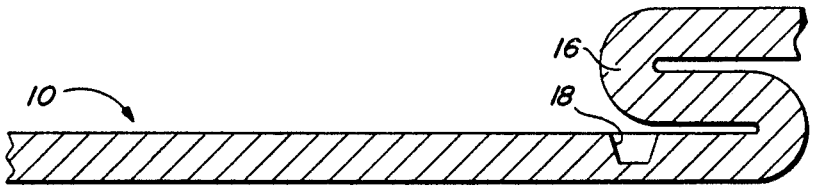
FIG. 2 is a partial cross section of the score line of FIG. 1, taken along the lines 2—2'.
Figure 3:
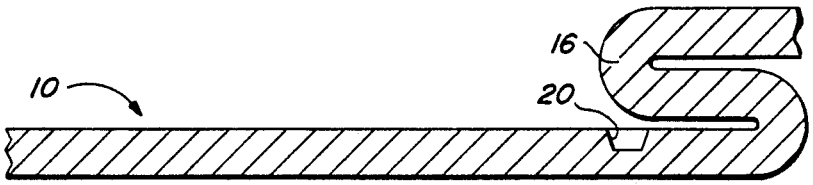
FIG. 3 is a partial cross section of the score line in FIG. 1, taken along the lines 3—3'.
Figure 4:
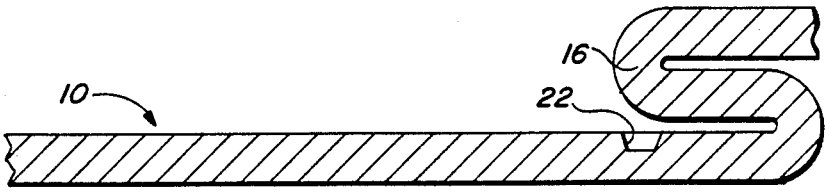
FIG. 4 is a partial cross section of the score line of FIG. 1, taken along the line 4—4'.

The score line which permits removal of the inside panel 12 extends in two different depths into the end panel. A first depth of the score line is defined as score line 18 in FIG. 2. In FIG. !, the areas of the score line are broken down by circle segments A, B, C, E and F. The depth of the score line 18 shown in FIG. 2 is to a first predetermined depth which easily achieves severing under normal operations and is typical of the depth used in conventional easy open containers in the prior art. By way of example, for a metal panel having a thickness on the order of 12.0 mils, the severing score line portion 18 extends a depth on the order of 7.0 to 8.0 mils, leaving about 4.0 to 5.0 mils of uninterrupted metal underneath the score line 18. As can be seen in FIG. 1, this score line 18 having a severing depth extends underneath the nose 28 of the pull tab 26 (area D) and along substantially all of the remaining portion of the end panel (i.e., score line areas E and F). Typically, area D has a width on the order of about 0.40 inches.

In accordance with the present invention, the score line is defined to a shallower, temporary retention depth 20 (FIG. 3) in an area (i.e., area C) of the end panel rearward from, and on a side opposite, the pull tab 26. Typically, the depth of the score line 20, FIG. 3, has the same angle of cut as the score line 18 of FIG. 2, but extends to a much shallower depth on the order of 2.0 to 4.0 mils, leaving approximately 8.0 to 10.0 mils of metal underneath the score line 20.

It is also suitable, although not necessary, to further provide for areas of shallower score line depth 22 (FIG. 4) along score line areas A and B, each on opposite sides of the nose 28 of the pull tab 26. These areas A and B of shallower score line depth on opposite sides of the nose 28 are not necessary to achieve the desirable retention characteristics of the present invention, but are useful in centering the nose 28 of the tab 26 at the desired position. This also facilitates release of the inside panel 12 symmetrically to area C, and permits easier release along area C by a back-and-forth flexing.

As discussed, it will be appreciated by those skilled in the container art that the temporary retention depth of the score line at 20 prevents inadvertent complete removal of the inside panel portion 12, but may then be easily released responsive to repeated back-and-forth flexing of the inside panel portion 12 toward and away from the outside panel portion 16 and about a hinge axis HA shown by dotted line in FIG. 1. The hinge axis HA extends laterally through area C and intersects the score line adjacent the two points where the two score line depths 18, 20 meet. It will further be appreciated that the temporary restraining and releasing means may constitute an independent weakened area along the rearward side, but as described above in the preferred embodiment, may easily be formed as a second depth of the score line which extends co-extensively about the container.

During manufacture, either of the score line depths may be first driven into the end panel, followed by a second scoring of the other depth. Of course, in accordance with typical manufacturing practices, the scoring occurs prior to the riveting of the pull tab to the inside portion so that the nose may be fixed over the score line at the desired position.

It will be appreciated by those skilled in the art that various modifications may be made in the improvements discussed above, without departing from the spirit and scope of the present invention as defined by the following claims.

What is claimed is:

1. An easy open end for pressurized containers, comprising:

an end panel;

a score line extending along a curved path about at least a portion of the periphery of the end panel, the score line defining a removable inside portion severable from a remaining outside portion of the end panel;

means along a first side of the end panel for severing the score line;

means including a weakened area coextensive with the score line along a second side of the end panel generally opposite the first side for temporarily retaining the second side with the outside portion as the first side moves outwardly away from the container during either inadvertent or intentional opening of the end; and wherein the curved score line has a first depth through the end panel, and wherein the weakened area comprises a second score line having a substantially shallower depth than the first depth.

2. The easy open end for pressurized containers recited in claim 1 wherein the temporary restraining means further comprises means for releasing the inside portion responsive to repeated flexing of the first side toward and away from the container.

3. The easy open end for pressurized containers recited in claim 1 further comprising at least one area of a shallower depth along the curved score line adjacent the severing means.

4. The easy open end for pressurized containers recited in claim 1 wherein the score line severing means comprises a pull tab fixed to the inside portion along the first side.

5. The easy open end for pressurized containers recited in claim 1 wherein the pull tab is located adjacent the score line along the first side and is spaced from the temporary restraining means along the second side.

6. An easy open end for pressurized containers, comprising:

an end panel;

a first curved score line of a first predetermined depth into the end panel and extending about substantially all of the periphery of the end panel, the first score line defining a removable inside portion severable from a remaining outside portion of the end panel;

a pull tab along a first side of the end panel for severing the first score line; and a second score line along a second side of the end panel and opposite the pull tab, the second score line extending a second predetermined depth into the end panel, the second predetermined depth being substantially shallower than the first predetermined depth, so as to temporarily retain the second side with the outside portion as the first side moves outwardly away from the container during either inadvertent or intentional opening of the end.

7. The easy open end for pressurized containers recited in claim 6 wherein the second score line is coextensive with the first score line.

8. The easy open end for pressurized containers recited in claim 7 further comprising two areas along the first score line adjacent to, and each on opposite sides of the pull tab, having a shallower depth than the depth of the remainder of the first score line.

9. An easy open end for pressurized containers comprising:

an end panel;

a pull tab fixed to the end panel, the pull tab having a nose and a ring for pulling the tab to drive the nose into the panel; and a score line passing through an area under the pull ring nose and extending in an enclosed curved path about the end panel so as to define a removable inside portion severable from a remaining outside portion of the end panel, the score line extending a first severing depth into the end panel in the area under the pull tab nose and substantially all of the remaining area of the score line except in an area rearward of the pull tab, the score line extending into a second, temporary retaining depth along the rearward area.

10. The easy open end for pressurized containers recited in claim 9 wherein the score line has two areas of the temporary restraining depth each on opposite sides of the pull tab nose.

11. A method for making easy open ends for pressurized containers, comprising the steps of:

providing an end panel;

scoring the end panel with a score line which extends in a curved path so as to define a removable inside panel portion severable from a remaining outside panel portion, the score line extending a first severing depth in substantially all areas except a temporary retention area, and the score line extending to a second, temporary retention depth along the temporary retention area; and providing a pull tab having a nose, and fixing the pull tab to the inside portion with the nose adjacent an area of the first severing depth and spaced from the temporary retention area.

* * * * *